United States Patent [19]

Valley

[11] Patent Number: 4,501,636

[45] Date of Patent: Feb. 26, 1985

[54] APPARATUS FOR ETCHING VERTICAL JUNCTION SOLAR CELL WAFERS

[75] Inventor: Charles R. Valley, Xenia, Ohio

[73] Assignee: The United States of America as represented by the Secretary of the Air Force, Washington, D.C.

[21] Appl. No.: 566,444

[22] Filed: Dec. 28, 1983

[51] Int. Cl.[3] ..... H01L 21/306; C23F 1/02; B44C 1/22; C03C 15/00

[52] U.S. Cl. ..... 156/345; 156/637; 156/662

[58] Field of Search ..... 156/345, 637, 639, 657, 156/659.1, 662, 626; 252/79.5; 134/85, 92, 105, 113, 34

[56] References Cited

U.S. PATENT DOCUMENTS

| | | | |
|---|---|---|---|
| 3,765,969 | 10/1973 | Kragness et al. | 156/17 |
| 3,964,957 | 6/1976 | Walsh | 156/637 X |
| 3,985,579 | 10/1976 | Rahilly | 136/89 |
| 4,155,866 | 5/1979 | Berkenblit et al. | 252/79.1 |
| 4,227,942 | 10/1980 | Hall | 136/255 |

FOREIGN PATENT DOCUMENTS

| | | | |
|---|---|---|---|
| 55-77141 | 6/1980 | Japan | 156/345 |

*Primary Examiner*—William A. Powell

*Attorney, Agent, or Firm*—Donald J. Singer; Charles E. Bricker

[57] ABSTRACT

An apparatus for etching semiconductor wafers which comprises a cylindrical vessel with a lid having associated cooling means, a basket assembly, rack means for holding a plurality of wafers, support means for supporting the basket assembly above the bottom of the vessel, and stirring means.

1 Claim, 2 Drawing Figures

APPARATUS FOR ETCHING VERTICAL JUNCTION SOLAR CELL WAFERS

RIGHTS OF THE GOVERNMENT

The invention described herein may be manufactured and used by or for the Government of the United States for all governmental purposes without the payment of any royalty.

BACKGROUND OF THE INVENTION

This invention relates to an apparatus for etching silicon wafers, particularly vertical junction solar cell wafers.

It is well known in the art to etch silicon with an anisotropic etchant such as an alkali metal hydroxide in aqueous solution. It is also well known to fabricate vertical junction solar cells by employing an anisotropic etchant. U.S. Pat. No. 3,985,579, issued Oct. 12, 1976 to William P. Rahilly, describes a process for fabricating a vertical multijunction solar cell having a plurality of channels providing vertical junctions formed in the upper surface of a semiconductor substrate which includes the steps of:

1. Forming an oxide over an entire P-type silicon slice with (110) orientation.
2. Photolithographically producing open lines in a photoresist applied over the oxide surface. The opened lines are accurately aligned parallel to the (111) planes in the silicon.
3. Removing the oxide in the opened areas.
4. Removing the remaining photoresist.
5. Etching the wafer in an aqueous solution of KOH to a desired channel depth.

It has been observed by the inventor that there exists no apparatus for etching silicon wafers for fabricating vertical junction solar cells.

Accordingly, it is an object of the present invention to provide an apparatus for etching silicon wafers for fabricating vertical junction solar cells.

Other objects and advantages of the present invention will be apparent to those skilled in the art from a consideration of the following detailed disclosure.

The novel features believed characteristic of this invention are set forth in the appended claims. The invention itself, however, may best be understood by reference to the following detailed description, when read in conjunction with the accompanying drawing, wherein:

Figure 1:
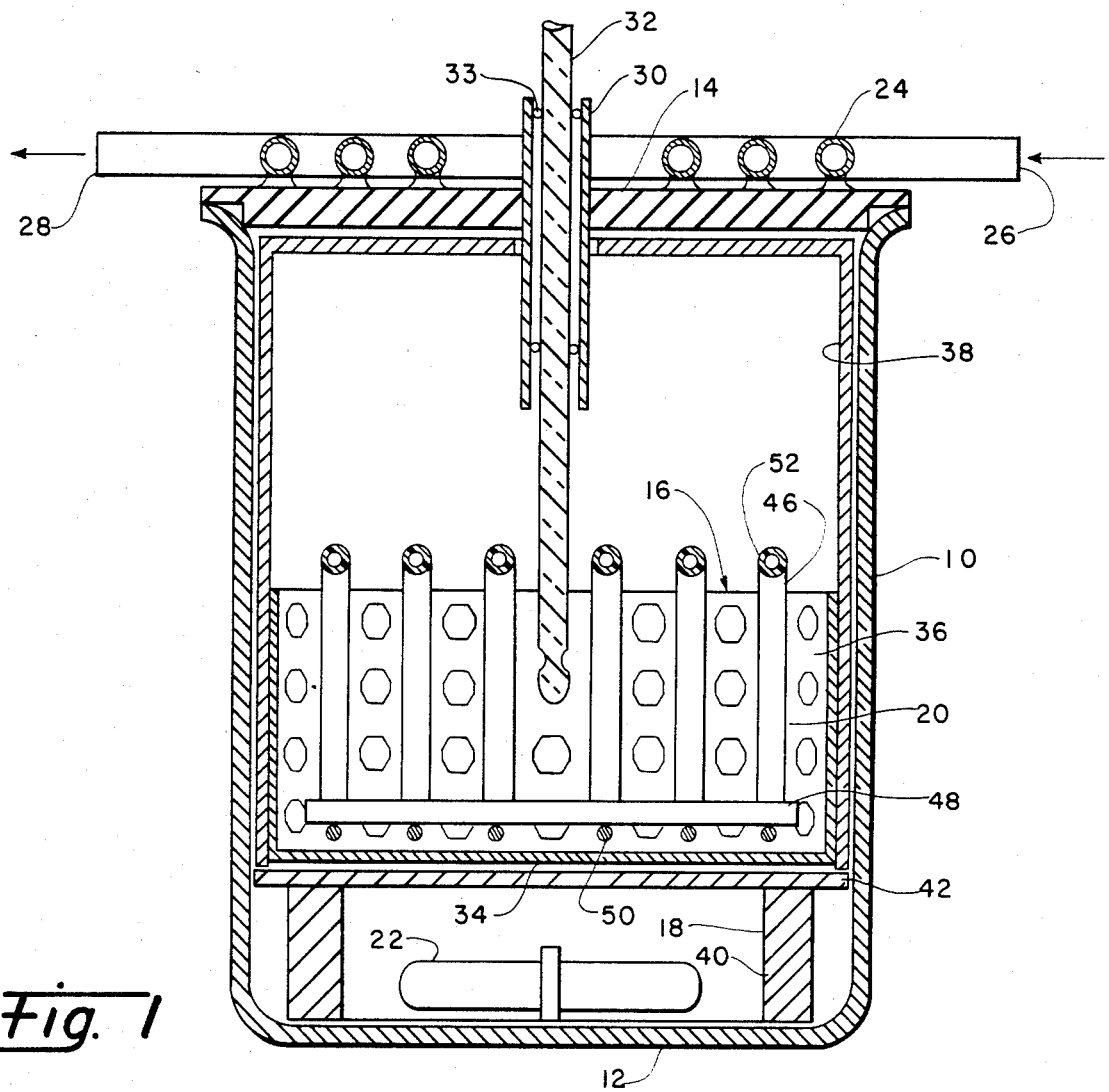
FIG. 1 is a cross-sectional view of the apparatus of this invention.

Referring to FIG. 1, the apparatus of this invention consists essentially of a cylindrical vessel 10 having a closed bottom 12 and an open top, a lid 14, a basket assembly 16 adapted for positioning within the vessel 10, basket support means 18 for supporting the basket assembly 16 above the bottom 12 of vessel 10, rack means 20 and stirring means 22. The lid 14 is adapted for closely fitting the open top of vessel 10. Lid 14 has cooling means in association therewith. In the embodiment shown, these cooling means include a plurality of spiral turns of tubing 24 soldered or otherwise affixed in heat transferring manner to lid 14, tubing 24 having an inlet end 26 and an outlet end 28. Lid 14 also includes means for holding a temperature sensor which, in the embodiment illustrated, consists of a tube 30 of sufficient length and inside dimension to securely hold a thermometer 32, or other temperature sensing means.

Thermometer 32 is held in place in tube 30 by one or more O-rings 33.

The basket assembly 16 has a porous or perforated bottom 34 and sidewall 36 to allow the etchant to circulate freely therethrough. Basket assembly 16 includes a handle assembly 38 for lowering the basket assembly into vessel 10 and for removing it therefrom.

The basket assembly 16 is supported above the bottom 12 of vessel 10 by a support means 18. In this embodiment the support means 18 includes a ring 40 and may include one or more crossbars 42 to provide additional support for the basket assembly 16. The height of the support means 18 must be sufficient to allow free rotation of the stirring means 22, which in this embodiment is a magnetic stirring bar adapted for being rotated by an external rotating magnet, as well as free circulation of the liquid etchant being stirred by the stirring bar 22.

The wafer rack means 20 comprises a base and a plurality of parallel, spaced apart, vertical partitions 46. The base includes a pair of parallel rods 48 held apart and in parallel relation by a plurality of crossrods 50. The partitions 46 have an inverted "U" shape with the open ends spot welded or otherwise affixed to the parallel rods 48. The partitions are covered with an elastomeric material 52 which is inert to the etchant.

Figure 2:
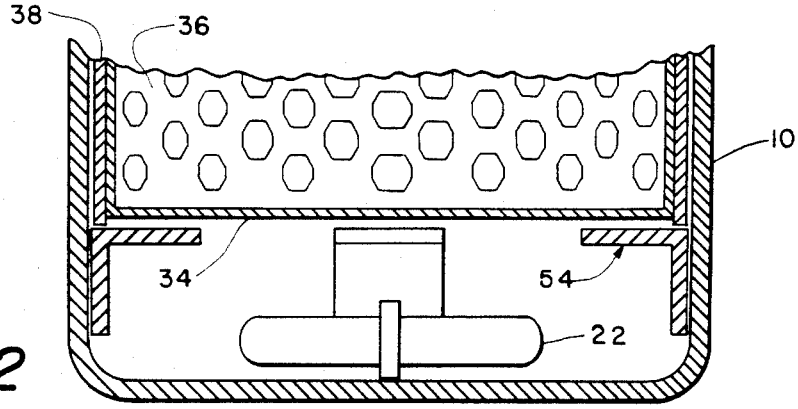
FIG. 2 is a cross-sectional view of a portion of the apparatus of this invention showing an alternate means for suspending the etching basket.

Referring to FIG. 2, the basket assembly 16 may, alternatively, be supported by a plurality of "L" shaped brackets 54 which are welded or otherwise affixed to the upright side of vessel 10.

The above described apparatus may be fabricated from a ferrous metal, such as stainless steel.

For etching, the stirring bar 22 and support means 18 are placed in the vessel 10 and the vessel is filled to a desired depth with a desired etchant. The vessel containing etchant is placed upon a hot plate or other heating means having an associated magnetic stirrer. The wafer rack means 20 is loaded with wafers to be etched and the loaded rack is placed into the basket assembly 16 which is then lowered into the etchant in the vessel 10. The lid 14, having tubing 24, connected to a source of cooling fluid and a drain, is placed onto vessel 10. Etching of the wafers is then carried out as is known in the art.

Various modifications may be made to the above described invention without departing from the spirit thereof or the scope of the appended claims.

I claim:

1. An apparatus for etching semiconductor wafers which consists essentially of, in operable association, a. a cylindrical vessel having a closed bottom and an open tap;
b. a lid for said vessel, said lid having cooling means in association therewith and having means for holding a temperature sensor;
c. a basket assembly adapted for positioning within said cylindrical vessel, said basket assembly having a porous bottom and a porous side and an open top and having handle means in association therewith for lowering said assembly into said vessel and for removing said assembly from said vessel;
d. support means for supporting said basket assembly above the inside bottom of said vessel to provide a free space between the bottom of said vessel and the bottom of said assembly;
e. rack means in association with said basket assembly for holding a plurality of semiconductor wafers for etching; and
f. stirring means.

* * * * *